US006606761B2

(12) United States Patent
Braid et al.

(10) Patent No.: US 6,606,761 B2
(45) Date of Patent: Aug. 19, 2003

(54) SPRING MOUNTING ARRANGEMENT FOR A SASH WINDOW COUNTERBALANCE ARRANGEMENT

(75) Inventors: Harold Keith Braid, Braceborough (GB); Simon Christopher Braid, Peterborough (GB)

(73) Assignee: Omega International LTD, Peterborough (GB)

( * ) Notice: Subject to any disclaimer, the term of this patent is extended or adjusted under 35 U.S.C. 154(b) by 0 days.

(21) Appl. No.: 09/973,384

(22) Filed: Oct. 8, 2001

(65) Prior Publication Data

US 2002/0104189 A1 Aug. 8, 2002

Related U.S. Application Data

(63) Continuation-in-part of application No. 09/777,088, filed on Feb. 5, 2001, now Pat. No. 6,393,661.

(51) Int. Cl.[7] ..... E05F 1/00

(52) U.S. Cl. ..... 16/197; 16/193; 16/DIG. 16; 49/445

(58) Field of Search ..... 16/197, 193, DIG. 16, 16/206, 205, 202, 400, 401; 49/176, 181, 445, 446, 447, 454, 456, 457

(56) References Cited

U.S. PATENT DOCUMENTS

| | | | | | |
|---|---|---|---|---|---|
| 2,644,193 | A | * | 7/1953 | Anderberg | 16/197 |
| 3,820,193 | A | * | 6/1974 | Foster | 16/197 |
| 3,869,754 | A | * | 3/1975 | Foster | 16/197 |
| 3,992,751 | A | * | 11/1976 | Foster et al. | 16/197 |
| 4,799,333 | A | * | 1/1989 | Westfall et al. | 49/176 |
| 4,922,657 | A | * | 5/1990 | Foss | 49/176 |
| 4,935,987 | A | * | 6/1990 | Sterner, Jr. | 16/197 |
| 4,953,258 | A | * | 9/1990 | Mennuto | 16/193 |
| 4,961,247 | A | * | 10/1990 | Leitzel et al. | 16/193 |
| 5,157,808 | A | * | 10/1992 | Sterner, Jr. | 16/197 |
| 5,207,025 | A | * | 5/1993 | Westfall | 49/430 |
| 5,210,976 | A | * | 5/1993 | Cripps | 49/181 |
| 5,353,548 | A | * | 10/1994 | Westfall | 16/197 |
| 5,365,638 | A | | 11/1994 | Braid et al. | |
| 5,661,927 | A | * | 9/1997 | Polowinczak et al. | 49/446 |
| 5,737,877 | A | * | 4/1998 | Meunier et al. | 16/197 |

FOREIGN PATENT DOCUMENTS

| | | | |
|---|---|---|---|
| GB | 1505782 | * | 3/1978 |
| GB | 2278626 | | 12/1994 |
| GB | 2295634 | | 6/1996 |

* cited by examiner

*Primary Examiner*—Chuck Y. Mah
(74) *Attorney, Agent, or Firm*—Testa, Hurwitz & Thibeault, LLP

(57) ABSTRACT

A sash window counterbalance arrangement for counterbalancing the weight of a sash window includes a spring support mounting located within a channel in a sash window jamb, a sash shoe slidable in the channel, a spring arrangement which generates a spring force between the mounting and sash shoe to counterbalance the weight of the window, the mounting including at least one mounting peg which projects from the mounting to engage a mounting aperture within one channel wall to locate and secure the mounting within the channel, with the mounting peg being resiliently biased into engagement with the aperture.

10 Claims, 7 Drawing Sheets

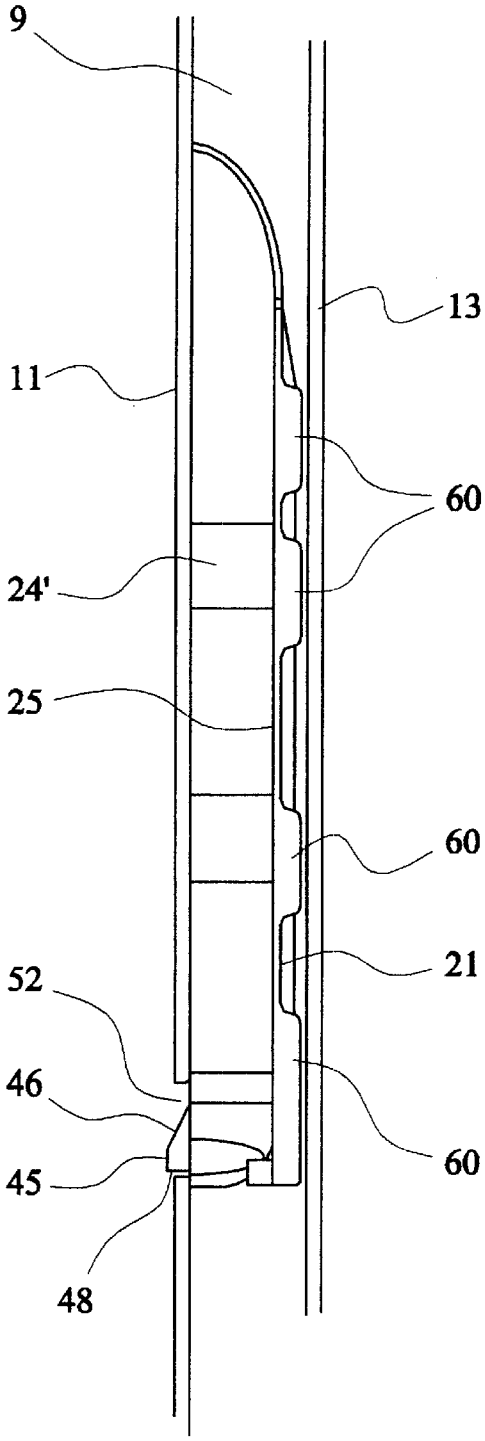
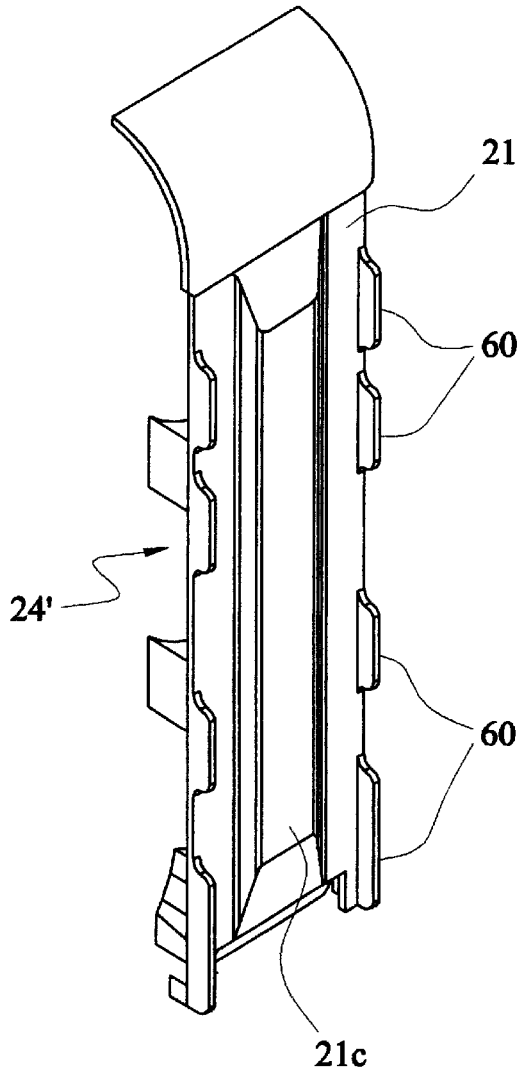
FIG. 7
FIG. 6

FIG. 9
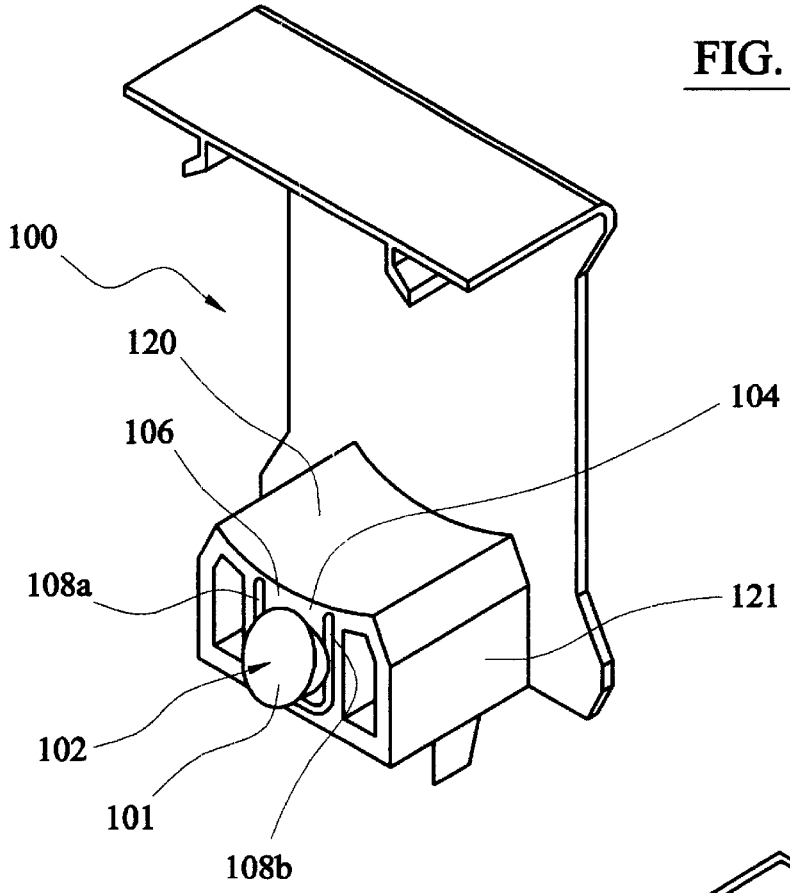
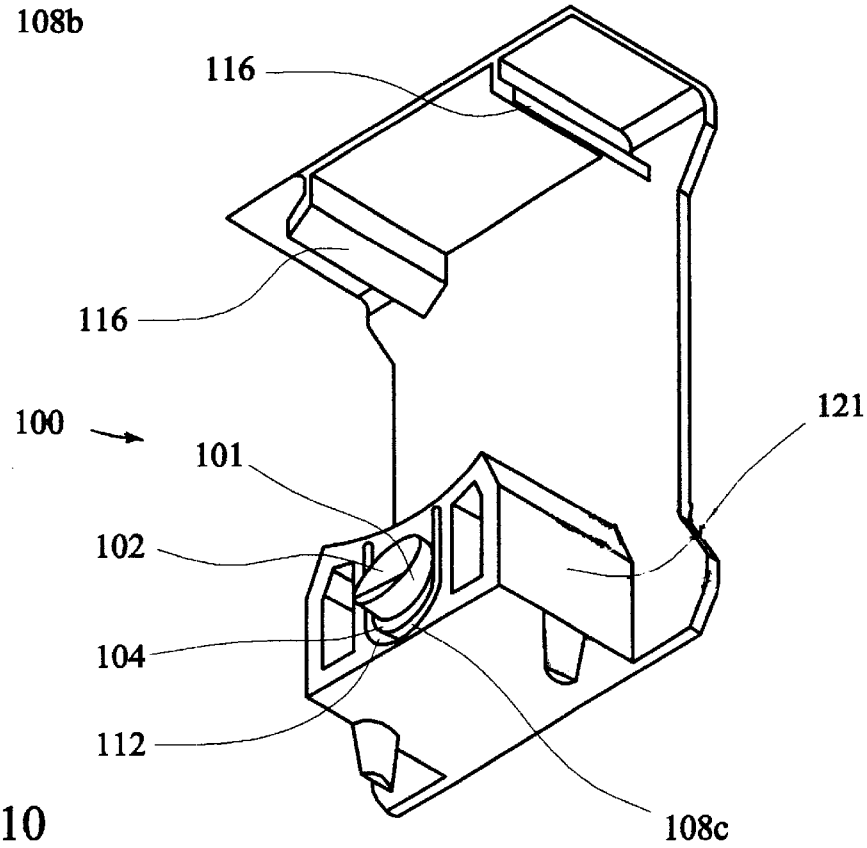
FIG. 10

SPRING MOUNTING ARRANGEMENT FOR A SASH WINDOW COUNTERBALANCE ARRANGEMENT

REFERENCE TO RELATED APPLICATION

The present application is a continuation in part of U.S. patent application Ser. No. 09/777,088, U.S. Pat. No. 6,393,661 filed Feb. 5, 2001 to the same inventors herein and having the same title.

BACKGROUND OF THE INVENTION

The present invention relates to sash windows and in particular to a mounting for the spring counterbalance arrangement used in such sash windows.

Modern sash window arrangements utilise flat coiled ribbon springs which are arranged to unwind as the sash window is slid and moved within a window frame. The coiled springs provide a counterbalancing force to counterbalance the weight of the sash window thereby making movement, and opening of the window easier. Typically the coiled springs are mounted, via a mounting arrangement, within a vertical channel section of the window frame or jamb. A free end, referred to as a tail, of the spring is connected to a sash shoe slidably mounted within the channel section of the window frame. The sash shoe in turn is connected to the sash window, usually towards the lower portion of the sash window.

The coil springs are generally of a constant tension type in which the outer profile of the coil itself is rotatably held and supported within the mounting, whilst an inner end of the spring is free such that the coil spring can rotate as the spring is unwound and the tail (outer end) is extended. To provide sufficient force to counterbalance the weight of the sash window multiple springs may be provided with the free ends or tails connected together.

An example of a prior arrangement, as generally described above, for mounting multiple springs for use in a sash window is described in U.S. Pat. No. 5,365,638 the contents of which are incorporated herein by reference.

As described in this prior patent, individual mounting means are provided for each of the coil springs. To provide a multiple spring assembly a number of individual mounting means are provided and stacked into an assembly within the window jamb. Other similar examples are disclosed in GB 2278626 and GB 2295634. A yet further arrangement is also described in our co-pending application GB 0027397.9 filed on Nov. 9, 2000, the text of which is incorporated in its entirety herein by reference.

In such prior systems the spring mounting assemblies are located within channels within the window frame or jamb. During assembly the spring mountings are inserted through an enlarged access portion of the channel, or inserted into the end of the channel, and are slid within the window jamb channel to the required position along the length of the channel. The mountings are then secured in position, along and within the channel, by means of a mounting screw, or number of mounting screws, which pass through the spring mounting and engage the window jamb. In this way the spring mounting, and so springs, are fixed and secured within the channel against movement within the channel.

Whilst this mounting arrangement, and similar prior arrangements, provide a practical method of mounting and supporting the springs, there are a number of problems with such an arrangement and the mounting arrangement can be improved generally.

In particular in a production environment the fitting of individual fixing screws to secure the support mounting within the channel is a relatively intricate and time consuming (and so costly) operation with the support having to be carefully aligned in position to allow the screws to be fitted. In addition the individual screws in themselves also increase the cost of the assembly.

In addition with some window frames due to the plastic material used a screw fixing is not advantageous since to prevent the screw fixing pulling out of the window frame a reinforcing plate need to be used which adds to complexity and cost.

A further problem in use and/or during assembly the sash shoe is sometimes inadvertently released from the sash window. This removal of load from the sash shoe can result in the sash shoe rapidly, and with some force, freely sliding within the channel under the tension of the counterbalance springs. The sash shoe will then contact and impact the fixed screw mounted spring support mounting with some considerable force and in some cases can fracture the support or shoe or strip the screws from the window frame. Such damage is clearly undesirable and indeed in some prior arrangements a rubber bump stop is provided to absorb the energy of any impact of the shoe with the spring support mounting. The cost of the rubber bump stop however is undesirable and also such systems do not entirely alleviate the problem.

SUMMARY OF THE INVENTION

It is therefore desirable to provide an improved sash window spring tensioning mounting arrangement which addresses some or all the above described problems and/or which offers improvements generally.

According to the present invention there is provided a sash window counterbalance spring mounting arrangement as described in the accompanying claims.

A sash window counterbalance arrangement for counterbalancing the weight of a sash window, in an embodiment of one aspect of the invention, comprises a sash window jamb with a channel defined within said sash window jamb. The channel has and is defined by a rear wall and a pair of side walls. The arrangement further comprises a sash window shoe slidable in said channel, spring means connected at one end to said sash shoe, and a spring mounting support fitted within said channel to support said spring means. In use a spring force is generated between said spring support and sash shoe to counterbalance the weight of said sash window. The spring mounting comprises at least one mounting peg which projects from said mounting to engage a mounting aperture defined within one of said channel walls to locate and secure said spring support mounting relative to said channel. Said mounting peg and aperture are arranged such that the spring support mounting is secured and located against slidable movement in use in a first direction due to the spring force, whilst movement of the mounting in an opposite direction causes disengagement of the mounting peg from the aperture.

Preferably a distal end of the mounting peg is profiled such that movement of said mounting in said opposite direction urges said mounting to disengage said mounting peg from said aperture. The distal end of the mounting peg may have a sloped profile. In particular a first portion of the distal end of the mounting peg projects further than a second portion of the mounting peg.

Furthermore a flange lip may project from a distal end of said mounting peg to define a hook means adapted to hook over a portion of the rear channel wall in the region of the aperture.

The mounting peg is preferably biassed into engagement with the aperture. Said biassing can be provided by resilient bending of the support and/or of the channel walls. Specifically said channel may further comprise front wall portions spaced a distance D from said rear wall. A front portion of said support abuts said front channel walls portions. The mounting pegs project from said support towards said rear wall such that the distance from said front portion of the support to the distal end of the mounting peg is greater than the distance D between said front and rear channel walls. In such an arrangement the support, and/or of the channel walls, are caused to deflect, or at least portions thereof, such that a resilient biassing force urging the mounting peg into the aperture is generated. The front portion of the support may comprise wing elements which project from a front surface of said support.

The support can be modular comprising a plurality of interengaged support elements. A plurality of mounting pegs may be used and provided.

A sash window counterbalance arrangement for counterbalancing the weight of a sash window, in an embodiment of another aspect of the invention comprises a sash window counterbalance arrangement for counterbalancing the weight of a sash window comprising a sash window jamb with a channel defined within said sash window jamb. The channel defined by and having a rear wall and a pair of side walls with at the extremities of said side walls inwardly directed front wall portions. A spring mounting support is fitted within said channel. The spring mounting comprises at least one mounting peg which projects from said mounting to engage a mounting aperture defined within one of said channel walls to locate and secure said spring support mounting relative to said channel. The mounting peg is resiliently biassed into engagement with said aperture.

A sash window counterbalance arrangement for counterbalancing the weight of a sash window, in an embodiment of another aspect of the invention comprises a spring mounting support fitted within the sash window channel. The spring mounting comprises at least one retractable mounting peg movable from an extended position in which the mounting peg projects from said support mounting to engage a mounting aperture defined within one of the channel walls to locate and secure said spring support mounting relative to said channel, and a retracted position.

Preferably said retractable mounting peg is resiliently biassed into said extended position.

In particular the mounting peg may project from a resilient and/or sprung portion of the support which is arranged to resiliently deflect and retract the mounting peg into the support and away from the channel/jamb wall and mounting aperture in the channel/jamb wall. Such a resilient or sprung portion of the support may comprise a cantilevered plate portion which is connected to the remainder of the support along one edge with the remaining edges substantially free from the support such that the plate element is hinged along the connected edge. The mounting peg projects from the cantilevered plate.

In one preferred arrangement the support mounting comprises a tang portion with said mounting peg projecting and extending from said tang portion. The tang portion is connected at one end to the support mounting such that the tang can pivot about said end of the tang connected to the support mounting to retract said mounting peg and tang into said support mounting.

The tang is generally parallel to the said channel wall. The tang may comprise a U shaped planar member.

A shoulder portion of said tang may also be defined at a distal end of said tang, said shoulder portion arranged to abut against said channel wall when said mounting peg is engaged in said a mounting aperture.

In another arrangement the resilient retractable sprung portion from which the mounting peg projects comprises cantilevered portion comprising:

- a leg member which extends from and is connected at one end to the support;
- a foot member which extends from the distal end of said leg member; and
- a flap portion which is supported from the distal end of the foot member with the mounting peg extending from said flap portion;
- said flap portion disposed generally parallel to and spaced from said leg member by said foot member and with the flap portion arranged to be disposed in use generally parallel to the channel wall.

A sash window counterbalance arrangement for counterbalancing the weight of a sash window, in an embodiment of a further disclosed aspect comprises a sash window jamb with a channel defined within said sash window jamb and having a rear wall and a pair of side walls. A sash window shoe is slidable in said channel. A spring means is connected at one end to said sash shoe, and a spring mounting support fitted within said channel to support said spring means is arranged such that in use a spring force is generated between said spring support and sash shoe to counterbalance the weight of said sash window. The spring mounting comprises at least one mounting peg which projects from said mounting to engage a mounting aperture defined within one of said channel walls to locate and secure said spring support mounting relative to said channel. A distal end of said mounting peg includes a flange lip which projects from a distal end of said mounting peg to define a hook means adapted to hook over a portion of the rear channel wall in a region adjacent the periphery of the aperture defined in said rear channel wall.

BRIEF DESCRIPTION OF THE DRAWINGS

The present invention will now be described by way of example only with reference to the following figures in which:

FIG. 6 is a schematic sectional view similar to FIG. 3, but of an alternative embodiment of the invention;

FIG. 7 is a perspective view of the spring support mounting shown in FIG. 6.

FIGS. 9 and 10 are perspective views of the spring support mounting shown in FIG. 8.

DETAILED DESCRIPTION

Figure 1:
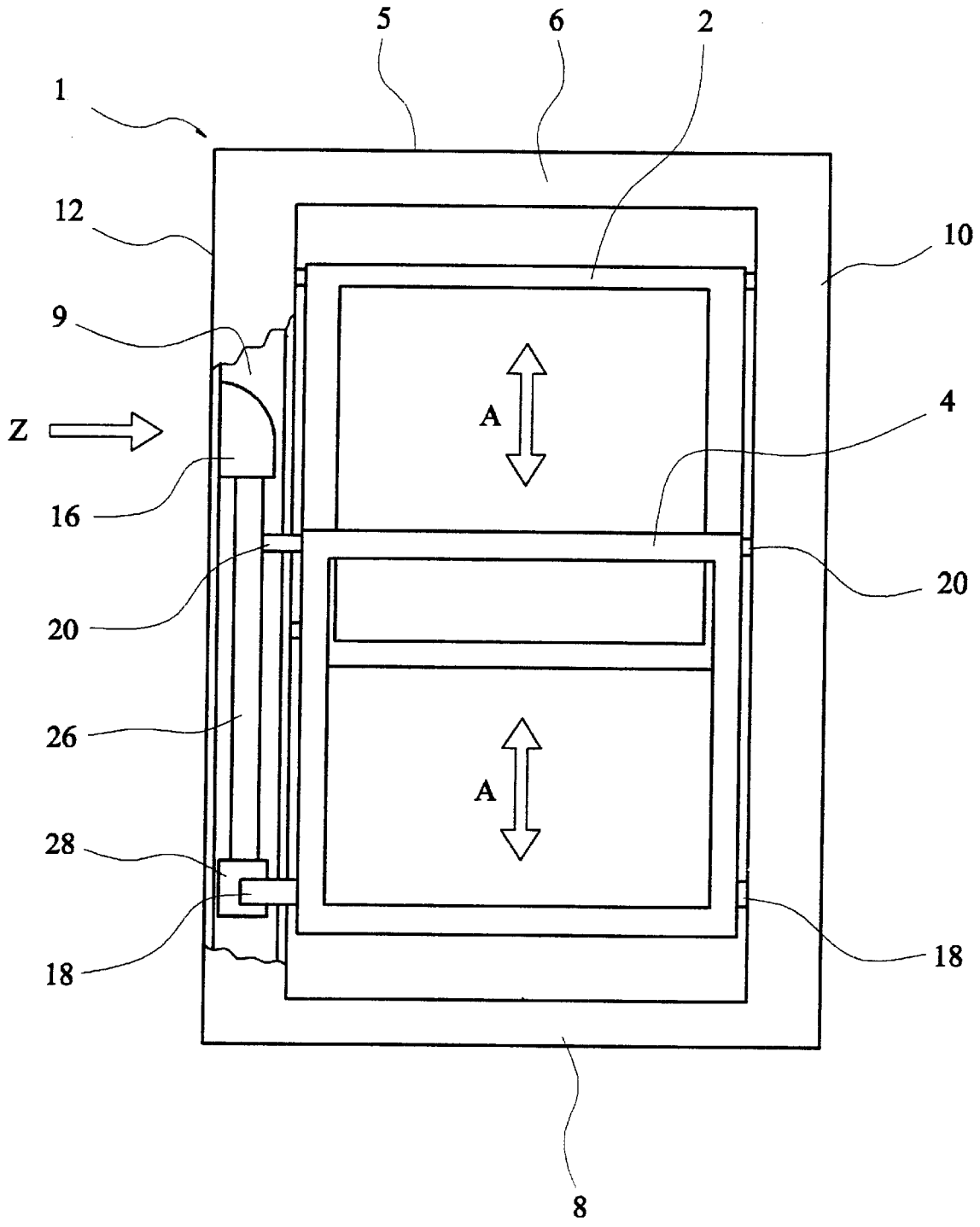
FIG. 1 is a schematic representation of a complete sash window assembly, with part of the window frame cut away to show the counterbalance spring mounting arrangement in accordance with the present invention.

Referring to FIG. 1, a sash window 1 comprises upper 2 and lower 4 sashes which are slidably mounted within a window frame 5 such that each sash 2,4 can be slid vertically, as indicated by arrow A, to open the window. The sashes 2,4 are disposed generally vertically and are disposed closely adjacent to each other with one sash 2 sliding behind the other 4. The window frame 5 comprises upper 6 and lower 8 horizontal frame members and two vertical laterally spaced window jamb members 10,12. The window jambs 10,12 have a double vertically extending channel section. Each channel section 9 of the double channel section is disposed side by side within the window jamb 10,12 adjacent and along the lateral side of a respective sash window 2,4 with an open part of the channel section 9 facing the sash window 2,4 and extending along the length of the window jamb 10,12. The cutaway portion of FIG. 1 shows a part of one of the channels sections 9 and the internally mounted components therein of the lower sash window 4.

Pivot pins 18, located towards the lower part of the sash window 2,4, extend and project laterally from the lower sides of the sash window 2,4. Tilt latches 20, located towards the upper part of the sash window 2,4, similarly project laterally from the sides of the sash window 2,4. The distal ends of the tilt latches 20 and pivot pins 18 are engaged within the open part of the window jamb channels 9. The sash windows 2,4 are thereby slidably located within and with respect to the window frame 5 by the engagement of the pivot pins 18 and tilt latches 20 within the channels 9 in the window jambs 10,12. The tilt latches 20 are also laterally retractable from engagement within the channel 9 such that upper portion of the sash window 2,4 can be disengaged allowing the sash window 2,4 to be tilted and pivoted about the pivot pins 18 to provide easy access to the window pane, in particular for cleaning.

Spring counterbalance mechanisms 16, to counterbalance the weight of the sash window 2,4, and make vertical sliding of the sash windows 2,4 easier, are mounted and located within the channel sections 9 of the window jambs 10,12 on each lateral side of the sash window 2,4 with a pair of such mechanisms 16 provided for each window 2,4. In FIG. 1 only one such mechanism 16 for one side of the sash window 4, is shown in the interest of clarity and brevity.

Figure 2:
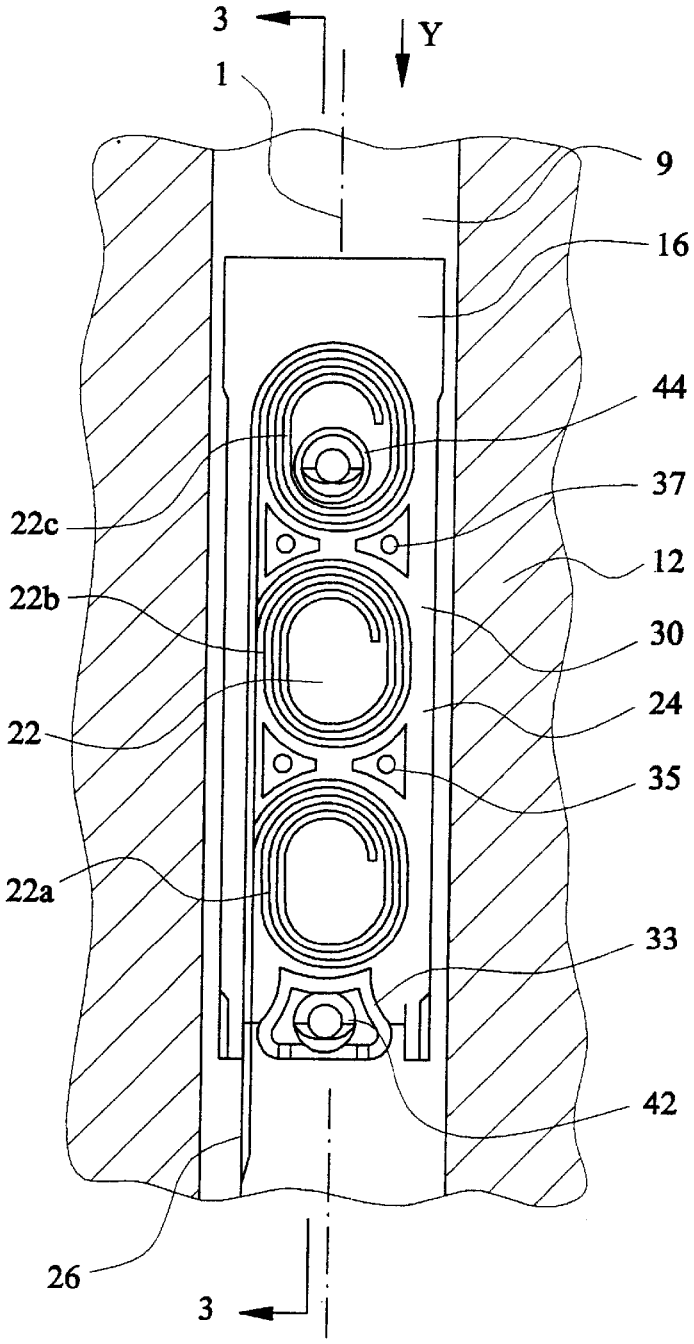
FIG. 2 is a schematic more detailed sectional view view through the window jamb channel of, one of the spring support mountings of FIG. 1.

The spring counterbalance mechanism 16 comprises a spring arrangement 22, typically one or more coil springs 22*a,*22*b,*22*c,* which are located and supported by and within a spring support mounting 24. The spring support mounting 24 is located within the channel section 9 within the window jamb 12 and is fixed and secured in position to the window jamb 12. The outer free ends of the springs 22*a,*22*b,*22*c* are connected together to form a common tail 26 which extends, and is drawn out from the spring support, and is connected to the sash shoe 28. The end portion or tail 26 of the spring arrangement 22 is connected to a sliding shoe 28 also located within the channel 9 and to which the pivot pins 18 are engaged. In operation as the sash window 2,4 slides vertically within the window frame 5 the sash shoe 28 slides vertically within the channel 9 and draws out the spring tail 26 from the spring support 24. Accordingly the spring arrangement 22 provides a vertical tension force as it is drawn out from the fixed spring support mounting 24. This provides a vertical counterbalance force to counteract and offset the weight of the sash window 2,4. The spring support mounting 24 and spring arrangement 22 are shown in more detail in FIG. 2.

The spring support mounting 24 comprises a plate like generally rectangular main body portion 25 with a front surface 21 which when installed in the jamb 12 faces outwards from the window jamb 12 channel section 9, and a rear surface 23 which faces towards and into the jamb channel section 9. Integral with the main body portion 25 and extending from the rear surface 23 thereof are spring support projections 33,35,37 disposed at spaced positions along the length of the main body portion 25 of the spring support mounting 24.

The spring arrangement 22 comprises three flat ribbon coiled springs, lower 22*a,* middle 22*b* and upper 22*c* (as considered in their final installed positions shown in figure 2), located within an on the spring support mounting 24. The outer coiled body portions of the three flat coiled ribbon springs 22*a,*22*b,*22*c* are supported by and on the respective spring support projections 37,35,33 of the spring support mounting 24. An axial end of the coil springs 22*a,*22*b,*22*c* abuts against the rear surface 23 of the main body portion 25 of the support mounting 24.

The inner free ends of the flat ribbon coil springs 22*a,* 22*b,*22*c,* in the centre of the coil springs, are generally free such that as the springs 22*a,*22*b,*22*c* unwind they rotate within the spring support mounting 24 and the springs 22 provide a generally constant force as they are, in use, unwound and the tail 26 is drawn out from the spring support 24.

The channel section 9, within which the spring support mounting 24 is installed is defined by a rear wall 11 facing outwardly towards the sash 2,4 and two side walls 11*a,*11*b* which extend from the rear wall 11. Short front wall portions 13, or flanges, generally parallel to the rear wall 11 extend oppositely inwardly from the ends of the side walls 11*a,*11*b* towards each other to partially close off and define the channel 9 (sometimes termed a jamb pocket) with an opening 40 of the channel 9 of a smaller dimension adjacent to the sash 2,4. Along a small section (typically 50 mm) of the channel section 9 however the front wall members 13 are removed, or reduced in extent, to provide an enlarged access opening (not shown) into the channel section 9. Such an opening in the channel section 9 is an industry standard and is to allow a spring counterbalance mechanism 16 and component parts to be inserted into, and removed from, the channel section 9.

Mounting pegs 42,44, which as shown are generally cylindrical, project and extend from the main body portion 25 of the support mounting 24 and rear surface 23 thereof. It will be appreciated though that the mounting pegs could have an oval, rectangular, square, hexagonal or other shaped cross section. The mounting peg could also be tapered such that it more easily engages the mounting aperture. In this embodiment a pair of mounting pegs 42, 44 are disposed towards the upper and lower part of the support 24 respectively. The distal ends of the mounting pegs 42,44 have a sloped profile 46 such that a lower portion 48 of the mounting peg 42,44 extends further from the support mounting than an upper portion (as shown in the figures). It will be appreciated that whilst in this particular embodiment a pair of mounting pegs 42,44 are used, the number of mounting pegs 42,44 may be varied depending upon the particular requirements of a particular spring support mounting and in particular the loading on the spring support 24. For example a single mounting peg may be used and positioned towards the lower end of the mounting (as in the embodiment shown in FIGS. 6 and 7), or an additional mounting peg could be provided part way along the spring support mounting 24.

Figure 3:
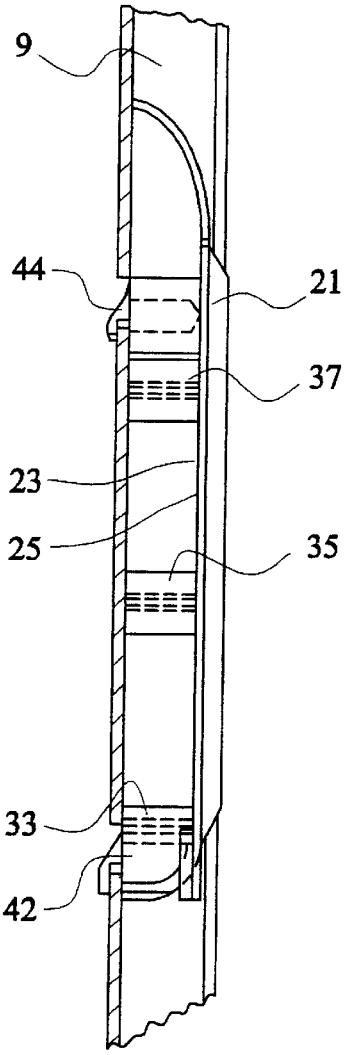
FIG. 3 is a schematic sectional view on line 3—3 shown in FIG. 2 of the spring support mounting with the springs omitted for clarity.
Figure 4:
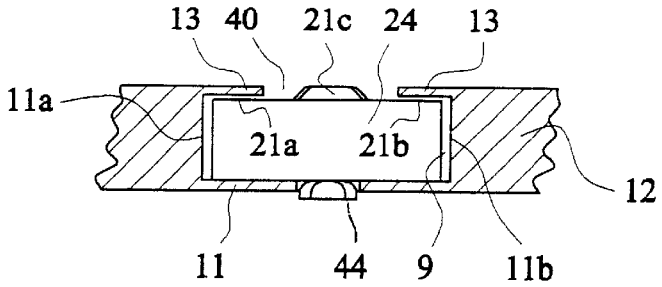
FIG. 4 is an end view on arrow Y shown in FIG. 2 of the spring support mounting located within the channel.
Figure 5B:
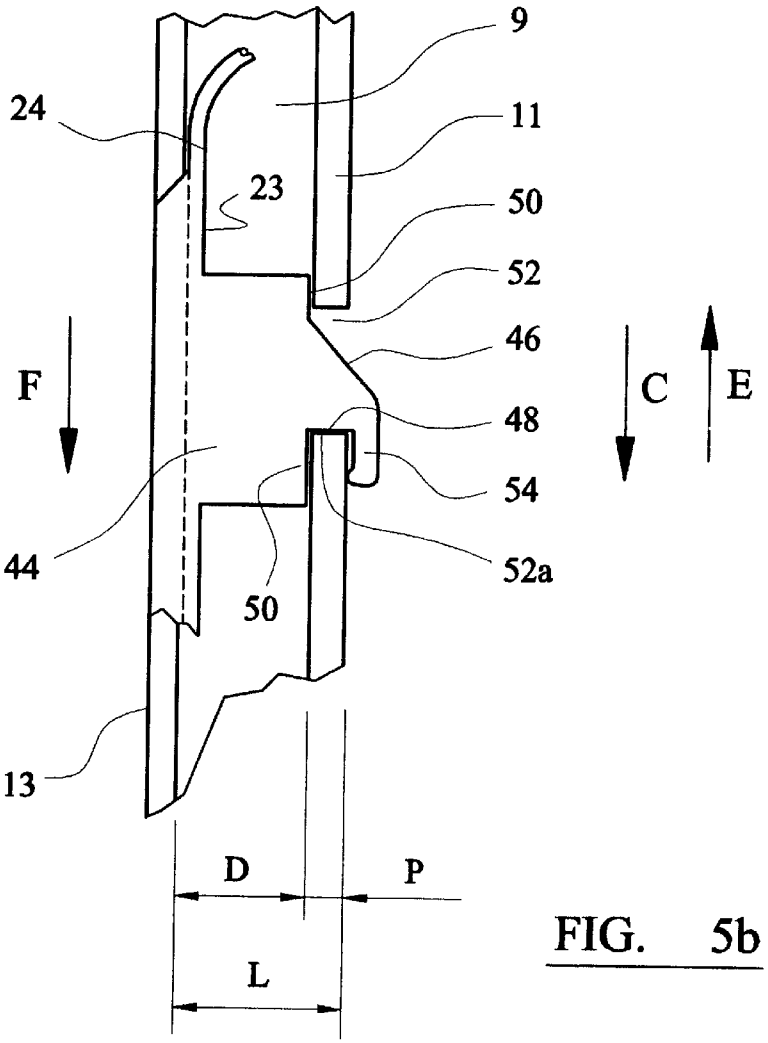
FIGS. 5*a* and 5*b* are more detailed views of a mounting peg of the spring support mounting illustrating the mounting peg of the spring support mounting into the window jamb in accordance with the present invention.

When the spring support 24 is mounted within the channel 9, as shown in figures 3 and 5*b*, shoulder portions 50 of the mounting pegs 42,44 abut against the rear wall 11 of the channel 9. A mounting hole 52, or suitable recess, is provided in the rear wall 11 of the channel 9 at a location where the support 24 is to be installed in the channel 9 and into which the mounting peg can be engaged. Such mounting hole may be formed by any suitable known means for example drilling. Alternatively the hole 52 may be formed by punching or routing etc. or may even be premoulded within the channel wall 9. The lower portion 48 of the mounting peg 42,44 extends into and is engaged within a respective corresponding predrilled mounting hole 52 within the rear wall 11 of the channel 9. Specifically the lower portion 48 of the mounting peg 42,44 engages and abuts against the lower section 52*a* of the predrilled hole 52 in the rear channel wall 11. Edge portions 21*a*,21*b* of the front surface 21 of the main body 25 of the spring support 24 abut against the front walls 13 of the channel 9. As a result and due to the resilience of the spring support 24 and/or of the channel walls, which are preferably fabricated from a resilient plastics material, the distal end of the mounting peg 42,44 is urged into the predrilled hole 52 and is maintained in engagement therein. In effect the dimensions of the spring support mounting 24, the projection of the mounting peg 42,44, and resilience of the spring support 24 and the arrangement as a whole, are arranged to provide a bias force to urge the distal end of the mounting peg 42 in the mounting hole 52. The mounting hole 52 is positioned at a corresponding position for mounting the support 24 at the desired position along and within the channel 9.

In addition a lip flange 54 extending perpendicularly to the mounting peg 42,44 and from the lower portion 48 of the mounting peg 42,44 defines a hook means with a slot recess 56 defined between the lip flange 54 and shoulder portion 50 of the mounting peg 42,44. When installed the lip flange 54 is hooked over the rear channel wall 11 with the slot 56 engaging with a portion of the rear wall 11 around and adjacent the lower part and peripheral region of the hole 52. The engagement of the mounting peg 44,42 is shown more clearly in FIG. 5*b* which shows a mounting peg 42,44 in the installed position.

In this way the spring support 24 is securely located and fixed in position along the channel section 9 of the window jamb 10,12 by the mounting pegs 42,44 and their engagement with the predrilled mounting holes 52 in the rear wall 11. The lip flange 56 provides further security in the mounting and engagement of the mounting peg 42,44. Furthermore in operation the load on the support mounting 24 generated by the spring arrangement 22 urges the spring support 24 downwards. This further urges the hook means into engagement with the lower sector 52*a* of the predrilled hole 52 and rear wall 11.

Figure 5A:
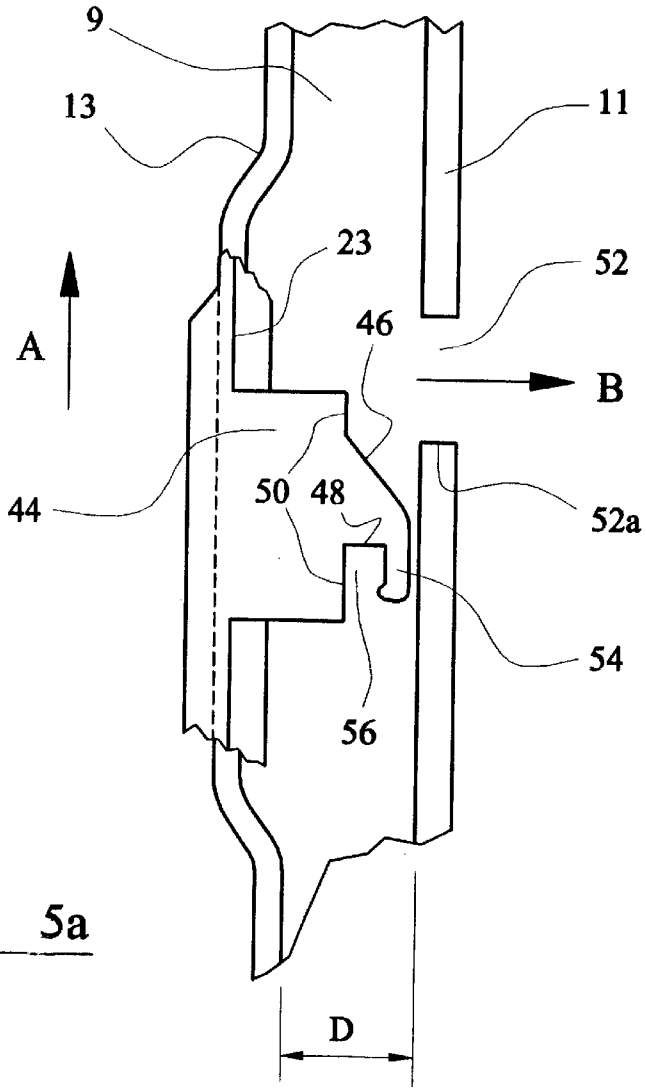

The spring support 24 is installed within the channel 9 through the enlarged access opening in the channel 9. Alternatively the support 24 may be inserted through the end of the channel 9. The support mounting 24 is then slid within the channel 9 to the required position adjacent to the predrilled mounting hole 52 provided at a location along the channel 9 where the support 24 is to be located. The support is preferably slid along the channel 9 in an upwards direction into position and the sloped profile 46 of the mounting peg 42,44 permits easy sliding of the support in this upwards direction. As the support mounting 24 is slid within the channel 9 the distal end of the mounting pegs 42,44 abuts against the rear wall 11 of the channel 9. The distal end of the mounting pegs 42,44 projects P further than the depth D of the channel section 9. The distance L from the abutting front portion 21*a*,21*b* of the support to the distal end of the mounting peg 42,44 being greater than the channel depth D. Consequently the support 24, and/or the channel walls, bow and bend about a longitudinal axis 1, with the centre portion 21*c* of the front surface 21 of the support bowing out through the channel opening 40 in order to be fitted within the channel 9 at positions where the mounting pegs 42,44 are not engaged within the mounting holes 52 and where the distal end of the mounting pegs 42,44 abut against the rear wall 11. This can be seen in FIG. 5*a* which shows the situation prior to engagement of the mounting pegs 42,44 within the holes 52. As illustrated the centre section of the support bows out through the channel opening 40. In addition the front channel walls 13 are bowed outwards slightly in the region of the support to accommodate the support mounting 24. It will be recognised that the other channel walls, in particular rear wall 11, could, depending upon their resilience and stiffness/rigidity, also bow and bend to accommodate the support mounting 24.

Once the support 24 is in position adjacent to the mounting holes 52, and the distal end of the mounting pegs 42,44 encounter the predrilled holes 52, the distal end of the pegs 42,44 are urged, by the resilience of the support 24 and its bowing, into the holes 52 and into engagement within the holes 52. Once the mounting pegs 42,44 enter the mounting holes 52, the support is moved downwards such that the lip flange 54 hooks over the lower sector 52*a* of the mounting hole 52 and rear wall 11 and the lower part of the mounting pegs 42,44 abuts against the lower sector of the mounting hole 52*a*. This downwards movement secures and ensures engagement of the mounting peg 42,44 within the mounting holes 52. The movement of the mounting peg 42,44 and support 24 during the installation is indicated by arrows A, B, and F in FIGS. 5*a* and 5*b*. The bowing of the support within the channel 9 biases the mounting pegs 42,44 towards the rear wall 11. Consequently the support 24 is self locating and self fixing within the channel as it is slid into the correct position.

To remove the support 24, the support 24 is slid upwards within the channel 9. The sloped profile 46 of the distal end of the mounting peg 42,44 and set back arrangement of the upper portion of the distal end of the mounting peg 42,44 allows and causes the distal end of the mounting peg 42,44 to be disengaged from the hole 52. The sloped profile of the distal end of the mounting peg 42,44 abuts against an upper edge portion of the mounting aperture 52 with the distal end of the mounting peg 42,44 thereby sliding over the edge and being urged out of engagement with the mounting aperture 52. This disengages the fixing of the support 24 to the rear wall 11 of the channel 9. The support 24 can then be slid further upwards and removed from the channel 9 through the access opening.

It will be appreciated that such upwards movement of the support 24 in normal operation is against and resisted by the spring tension provided by the spring arrangement 22 and resultant downwards loading on the support 24. Downwards movement of the spring support 24 is prevented by the engagement of the lower portion 48 of the mounting peg 42,44 with the hole 52 in rear wall 11. In effect the profiling and arrangement of the mounting pegs 42,44 shown provides in this embodiment a unidirectional locating and securing of the support 24. This means that movement of the support 24 in a first direction (downwards), indicated by arrow C, is resisted by the mounting arrangement whilst movement in the opposite direction (upwards), indicated by arrow E causes disengagement and is permitted.

In the event of inadvertent release of the sash shoe 28 from the sash window 2,4, or removal of the load from the sash shoe 28, the sash shoe 28 will rapidly move upwards with some force under the influence of the spring tension and spring arrangement 22. In such a case the sash shoe 28 may impact the bottom lower end of the spring support 24 with considerable force. Rapid upward movement of the sash window 2,4, and so of the sash shoe 28, by an operator opening the window may also cause the sash shoe 2,4 to impact the bottom of the spring support mounting 24. In these cases with prior arrangements damage can be caused to the spring mounting. However with the mounting arrangement of the invention described above, the support mounting 24 can, in a similar manner as with removal of the spring mounting 24, move upwards following such impact and will automatically become disengaged with the impact energy being gradually absorbed. As a result, and since the support 24 can move following the impact any potential damage is reduced.

In this particular embodiment shown and described the front surface 21 of the support 24 abuts against the front wall 13 of the channel and bowing of the entire support mounting 24, and/or the channel walls, provides a resilient biassing force to urge the mounting peg 42,44 into the mounting hole 52. In alternative embodiments however such biassing of the support 24 may not be required and/or even desired in order to make installation easier. In such cases the support 24 and mounting peg 44 projecting from the support 24 would be arranged and dimensioned to be accommodated within the channel section 9 without requiring bending of the support and/or of the channel walls. When the support is installed the front surface 21 of the support 24 would not abut against the front channel walls 13. The hooking of the lip flange 54 over the rear channel wall 11 then becomes a more significant feature when there is no biased load, with the hooking of the lip flange providing the main means to secure the mounting peg 44 in engagement with, and within, the mounting hole 52.

FIGS. 6 and 7 show a further alternative embodiment of the invention. This embodiment is generally similar to that shown in the previous figures and like reference numerals have been used for like features, with only the main differences now being described.

The spring support mounting 24' of this embodiment includes only a single mounting peg 45 which is disposed towards the lower end of the spring support mounting 24'. This mounting peg 45 also does not include a lip flange and, as shown the mounting peg 45 simply engages within the mounting hole 52 within the rear wall of the channel 9.

Since the mounting peg 45 does not include a lip flange, the biassing of the support 24' when fitted within the channel 9, as described in the first embodiment, is more significant in the arrangement of FIGS. 6 and 7 in order to ensure that the mounting peg 45 remains in engagement with mounting hole 52. In this embodiment wing projections 60, projecting from the front surface 21, are provided along the sides of the main body of 25 of the support mounting 24. The distal edges of these wing projections abut, when the support is installed within the channel 9, against the front walls 13 of the channel 9. The wing projections space the front surface 21 of the support mounting 24 from the front walls 13 of the channel 9. Bending of the wing projections, in addition or instead of bending or bowing of the support and/or of the channel walls, provides a resilient bias force to urge the distal end of the mounting peg 45 into the mounting hole 52 and maintain engagement of the mounting peg 45 within the mounting hole 52. It will be appreciated that such wing projections can be made more flexible than the remainder of the support mounting 25 and or the channel walls. Such wing projections as used in a spring support in general are shown and described in our co-pending application GB 0027397.9 filed on Nov. 9, 2000, the contents of which are hereby incorporated herein by reference.

It will be recognized that whilst wing projections 60 are illustrated in the arrangement of FIG. 6, and in some cases are preferred in other embodiments the bending and bowing of the support 24 and/or channel walls 11,13 may provide sufficient deflection to accommodate the spring support 24 and provide the required degree of resilience. Consequently an arrangement of FIG. 6, but without wing projections and with the front surface 21 abutting the front channel walls 13 is envisaged.

In a variation the mounting peg could be retractable. The mounting peg is retracted to allow the support to be slid into position within and along the channel with the mounting peg extending to project into the mounting hole when in the position adjacent to the mounting hole. Such a retractable mounting peg is baissed towards an extended projecting position such that engagement with the mounting hole is automatic once the support is slid into position.

Figure 8:
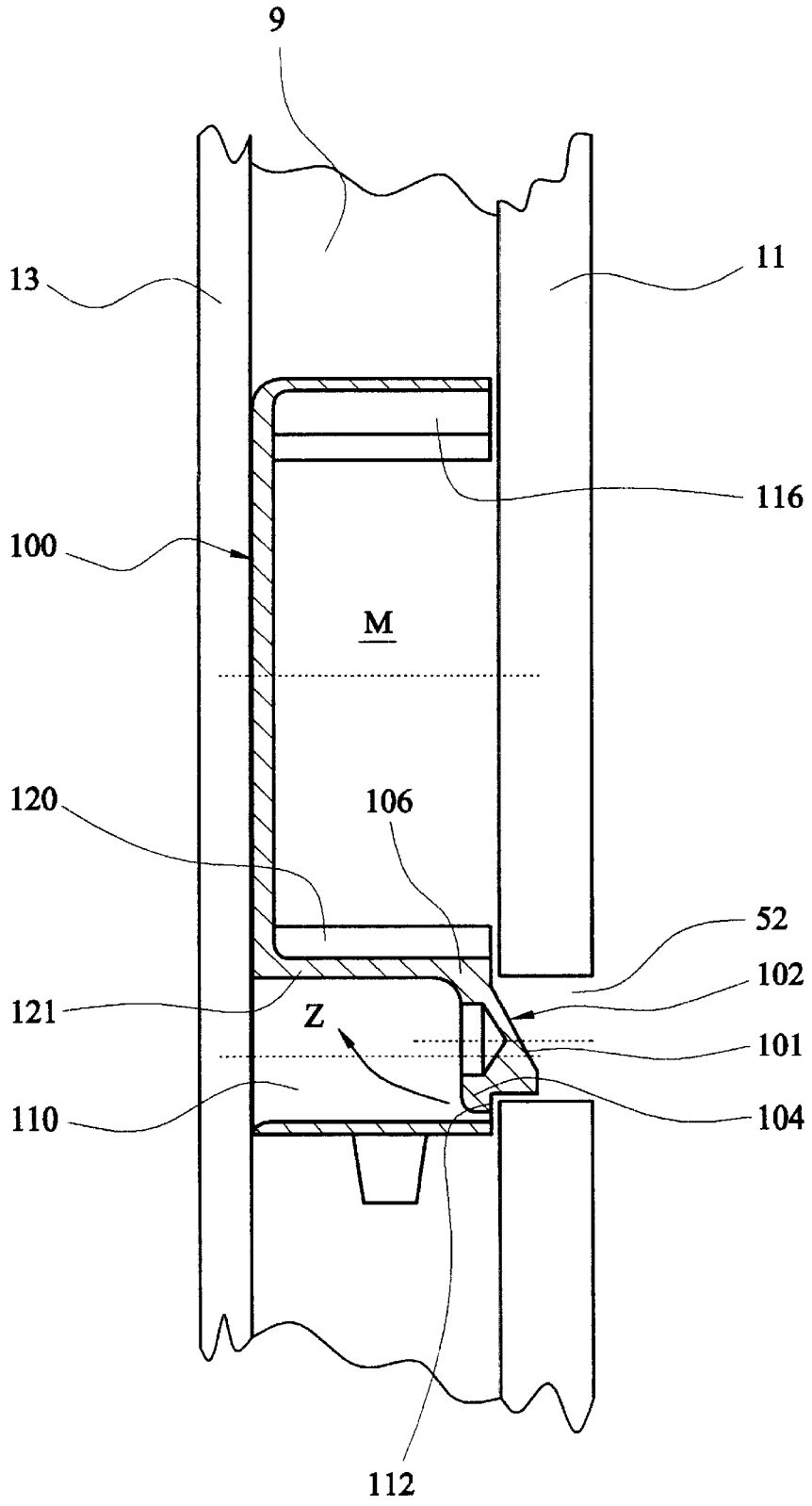
FIG. 8 is a schematic sectional view similar to FIG. 3, but of a yet further alternative embodiment of the invention.

A further embodiment and variation of the present invention is shown in FIGS. 8,9, and 10. This embodiment is generally similar to the previous embodiments discussed above and only the main differences will now be described.

The main difference in this embodiment is the use of a mounting peg 102 arrangement which can flex and/or retract the mounting peg 102 mounted thereon into the support mounting 100 and out of engagement with the aperture 52 in the channel wall 11. The mounting peg 102 is arranged to be resiliently biassed into a projecting position with the peg 102 projecting from the support mounting 100 and into engagement with the aperture and channel wall 11. In particular the arrangement comprises a portion 104 of the support 100 from which the mounting peg 102 projects, with this portion 104 flexibly attached to the remainder of the support 100 such that the mounting peg 102 extending from this portion 104 can be retracted and deflected into the support 100.

The support mounting 100 of this embodiment is adapted and arranged to support a single coil spring (not shown), disposed in chamber M defined in the support mounting. This coil spring, in a similar manner to the springs of the other embodiments, is supported on a lower support projection 121 which define a curved support surface 120 upon which a lower outer curved peripheral surface of the flat coil spring abuts. The support mounting also includes upper spring support projections 116 to close off the top of the support mounting and contain the spring within the mounting. It will be appreciated though that in variations of this embodiment the support mounting 100 could be configured to support multiple springs, as for example shown in the previous embodiments.

A mounting peg 102 projects and extends from the support 100 and the plane of the rear surface of the support 100. When the support 100 is installed within the channel section 9 this mounting peg 102 engages the mounting aperture 52 in the rear channel wall 11 to locate and mount the support mounting 100 within the channel 9. The distal end of the mounting peg 102 has a sloped profile 101 such that the a lower portion of the peg 102 projects further from the support 100 that an upper portion, as with the mounting pegs of the previous embodiments.

As shown in this embodiment the mounting peg 102 projects and extends from a tang (or tongue) portion 104 of the support 100. This tang 104 comprises a generally U shaped planar member and portion of the support mounting 100. The sides 108*a*,108*b* and curved bottom edge 108*c* of the U shaped tang 104 are separated and free from the remainder of the support mounting 100. As such the tang 104 is free of the remainder of the support 100 on three sides/edges, whilst attached to the support about one edge/hinge portion. The mounting peg 102 is arranged and extends generally perpendicularly to the tang portion 104 which is disposed parallel with the rear surface of the support mounting 100 and when installed rear channel wall 11. The upper part of the tang 104 is connected/integral with the support mounting such that the tang 104 is resiliently hinged about the upper part where it is connected to the remainder of the support mounting 100. The tang and distal end of the tang are able to flex and pivot about the connected end due to the natural resilience of the material. In other words the tang 104 comprises a cantilevered portion of the support 100 from which the mounting peg 102 projects. This cantilevered arrangement is such that the cantilevered portion (tang 104) can be resiliently deflected into the support 100 and the mounting peg thereon thereby retracted into the support 100 such that the mounting peg does not protrude beyond the rear plane of the support 100.

In its normal, undeflected state, as shown in the figures the tang 104 is generally vertical with the mounting peg 102 projecting from the support mounting 100. Alternatively the tang 104 in its normal state may be angled slightly outwards such that it protrudes outwards away from the support 100 to provide a slight outwards pressure against the channel wall 11 when installed to further enhance and ensure/maintain engagement of the mounting peg 102 within the locating/mounting aperture 52. During installation of the support mounting and sliding of the support within the channel 9 the tang 104 can however pivot and flex about the upper part 106 and away from the channel wall 11 as shown by arrow Z. This in effect retracts the mounting peg 102 into the support mounting 100 and chamber 110 such that the distal end of the mounting peg 102 no longer projects as far from the support mounting. The arrangement of the tang 104 and mounting peg is specifically such that there is provided sufficient space for the tang 104 and mounting peg 102 to deflect and retract the mounting peg 102 into the support mounting 100 and so that the mounting peg 102 does not project from the support 100. This allows the support 100 to be fitted and accommodated within the dimensions of the channel section 9. The resilience of the tang 104 and flexing of the tang 104, in the deflected state, however urges and biases the tang 104 to its normal position (as shown) with the mounting peg 102 projecting from the support 100, beyond the plane of the rear surface of the remainder of the support 100. During installation the distal end of the mounting peg 102 abuts against the rear wall 11 thereby maintaining the tang in a flexed state with the mounting peg 102 retracted. Once though the support 100 is in the installed position along the channel 9 and the mounting peg 102 is aligned with the locating aperture 52 in the channel wall 11 the tang 104 then flexes back to its normal position and the mounting peg 102 is urged into engagement with the aperture 52.

Consequently by this arrangement and in this embodiment with the mounting peg 102 projecting from a flexible tang portion of the support mounting the support and/or channel walls do not need to bow or bend to allow the support mounting to be installed as is the case with some of the previous embodiments described above. This arrangement can therefore be used with window jambs and channel section 9 made from substantially inflexible and/or rigid materials for example wood, aluminium, pultrusions (glass reinforced plastic frames) or cellular PVC. Such window frames would not otherwise deflect sufficiently to accommodate the previous arrangements where the channel section has flex during installation of the support mounting. Furthermore, with the tang flexing and retracting the mounting peg during installation the remainder of the support mounting does not need to flex during installation and consequently can be more rigid than is the case with the previously described arrangement in which the support was required to flex and bow.

The pivoting and hinging of the tang 104 about an upper part 106 advantageously means that as the support is slid upwards (as is the case during installation) the tang will more easily tend to, and preferentially, flex and pivot inwards as shown by arrow Z and retracting the mounting peg 102. The sloped profile 101 of the distal end of the mounting peg 102 similarly assists in this. This makes installation, when the support is generally slid upwards easier and allows the support to be disengaged and removed similarly to as described in relation to the other embodiments. Conversely if the support is moved downwards, or is under downwards load (as is the case when installed and in use) the tang 104 will tend to preferentially pivot outwards towards the rear wall 11 and urge and maintain the mounting peg 102 in engagement with the locating aperture 52.

The length of the tang portion 104 and disposition of the mounting peg 102 on the tang is such that lower part of the mounting peg 102 is spaced from the distal end of the of the tang 104 to thereby define a shoulder portion 112 or lip at the distal end of the tang 104. When the support 100 is installed into the channel section 9 and the mounting peg engaged in the aperture this shoulder portion 112 can abut against the rear wall 11 to prevent the tang portion 104 as a whole from flexing (in the opposite direction to that indicated by arrow Z) into the aperture 52.

In the embodiment shown in figures 8 to 10 the mounting peg 102 does not include a lip flange at the distal end of the peg as used in the embodiment shown in figure 3. The mounting peg 102 is held in engagement with the mounting hole 52 by resilience of the tang 104 urging the mounting peg 102 into engagement with the mounting hole 52, and abutting of the front of the support 100 with the front channel walls 13. It will be appreciated though that a lip flange as described in the previous embodiments could be used.

Figure 11:
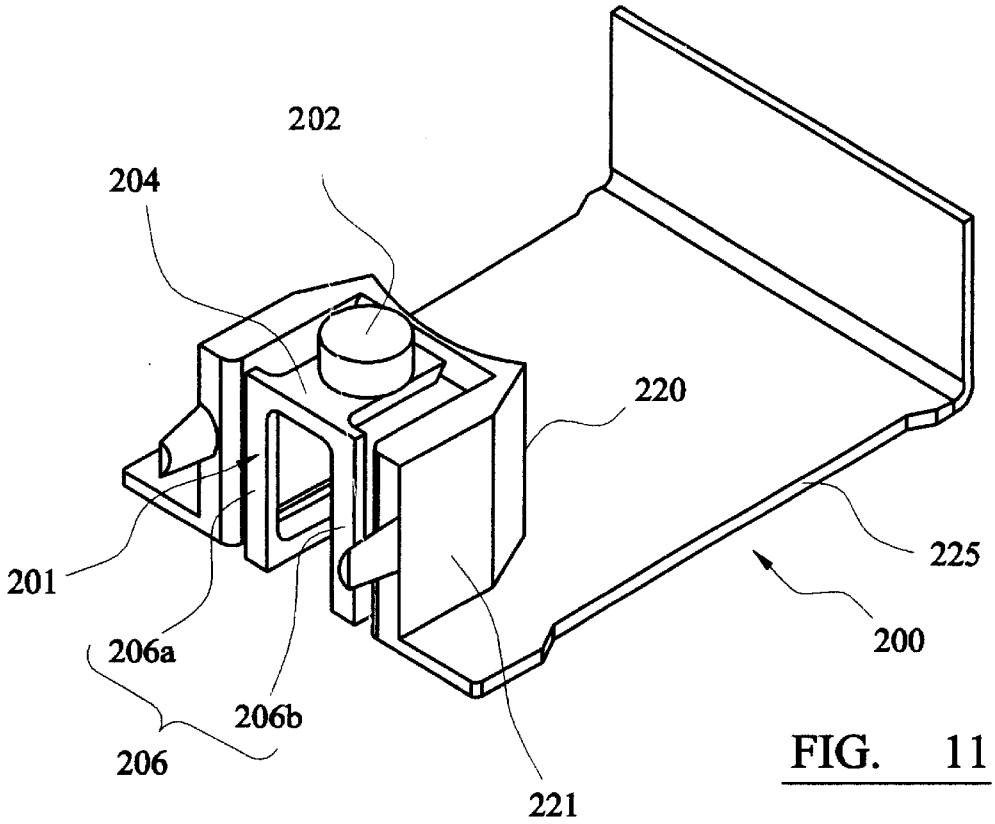
FIGS. 11 and 12 are perspective views, similar to those of FIGS. 8 and 9, of a spring support mounting according to a further embodiment.
Figure 12:
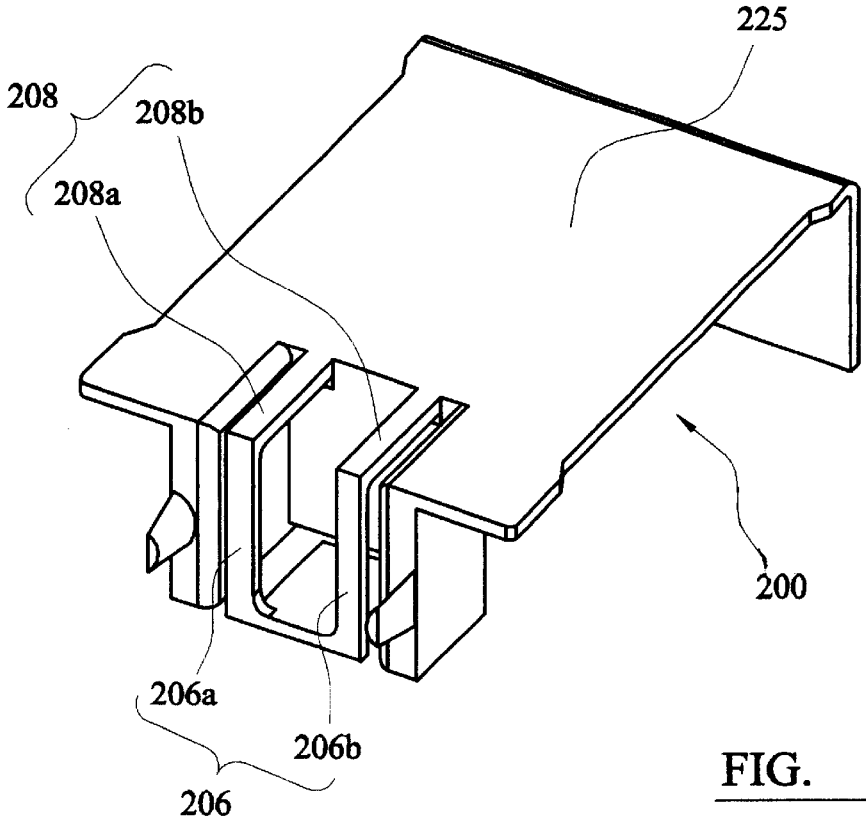

FIGS. 11 and 12 show a yet further embodiment and variation of spring support arrangement. This arrangement is generally similar to the previous embodiments discussed above, and in particular the arrangement shown in FIGS. 8,9, and 10.

The support 200, similarly to the previous embodiments is arranged to be inserted and mounted within the channel 9 section of a window jamb 11,12 and provide a support for a sash window spring. The support 200 comprises a main body portion 225 providing a front surface which abuts against the front walls of the channel 9. The support 200 also includes a lower support projection 221 projecting from the main body portion 225 and providing a curved surface 220 upon which in use a coiled spring (not shown) abuts and rests and is supported. The support 200 also includes a mounting peg 202 which projects from the support 200 and in use is engaged within a mounting aperture or recess 52 in the rear channel wall 11 in order to locate and fix the support 200 at the required position along and within the channel section 9.

The mounting peg 202 in this embodiment is arranged to be resiliently retractable, similarly to the embodiment shown in FIGS. 8,9,10. In this case though a different arrangement is used to allow the mounting peg 202 to allow the mounting peg 202 to retract.

As shown, the support 200 includes a cantilever arrangement 201 upon and from which the mounting peg 202 projects. This cantilever arrangement 201 comprises a pair of leg members 208*a*,208*b*, together forming a leg portion 208, which are attached at one end to the remainder of the support and specifically to the main body 225 of the support 200. Foot members 206*a*,206*b*, together forming a foot portion 206, extend from the distal end of the respective leg member 208*a*,208*b*. The distal end of these feet members 206*a*,206*b* support a flap portion 204 from which the mounting peg 202 extends. The leg members 208*a*,208*b* are disposed such that they extend along the plane of the in use front surface of the support 200 in an installed downwards direction. The feet members 206*a*,206*b* are disposed substantially perpendicularly to the leg members 208*a*,208*b* and extend across the bottom of the support across the depth of the support 200. The flap portion 204 is disposed perpendicularly to the feet members 206*a*,206*b* and substantially parallel to the leg members 208*a*,208, with the flap extending, in use, vertically upwards from the feet members 206*a*,206*b* and supported by the feet from a bottom edge. In this way the flap portion 204 is disposed in its normal state generally parallel and in line with the plane of the rear surface of the support 200.

This cantilevered arrangement 201 provides a means for the mounting peg to be retracted into the support 200 with the leg member 208*a*,208*b* and flap portion 204 deflecting and bending. The arrangement of leg 208 and feet 206 members supporting the flap portion 204 used in this embodiment more easily allows the mounting peg 202 to be deflected and retracted into the support 200 than the arrangement of FIGS. 8,9, and 10.

In this embodiment, as shown, the distal end of the mounting peg 202 is flat, as opposed to the sloped profile of the previous embodiments. As such in this embodiment the mounting peg 202 will not automatically release as with the previous embodiments which incorporated a sloped profile on the distal end of the mounting peg. It will be appreciated though that the distal end of the mounting peg 202 could be provided with a sloped profile 101 such that the lower portion of the peg 202 projects further from the support 100 than an upper portion, as with the mounting pegs of the previous embodiments. Similarly a flat distal end of the mounting pegs of the previous embodiments could also be used to simplify construction if the automatic disengagement is not required.

Modular spring mounting arrangements are also known comprising a series of spring support elements which are stacked on top of each other with each element supporting an individual spring. Such an arrangement is shown in U.S. Pat. No. 5,365,638. The mounting peg, or spigot, arrangement of the present invention described above can be applied to secure such similar arrangements within the channel of a window jamb and in place of the screw type fitting conventionally used in such arrangements. Mounting pegs can be provided for each spring support element. Alternatively mounting pegs can be provided for only some of the elements making up the modular spring support with the other elements being located and secured by their interengagement with those elements incorporating a mounting peg. Indeed a mounting peg can be provided on only the lowermost spring support element with the remaining element of the modular spring support stacked on top of the lowermost element and being supported by and on the lowermost element.

Many other variations of the invention will also be apparent to those skilled in the art and various different combinations of the individual features of the different embodiments described are contemplated.

What is claimed is:

1. A sash window counterbalance arrangement for counterbalancing the weight of a sash window comprising:

a sash window jamb with a channel defined within said sash window jamb by a rear wall, a spring support mounting fitted within said channel, the spring support mounting comprising at least one retractable mounting peg movable between an extended position in which the retractable mounting peg projects from said spring support mounting to engage a mounting aperture defined within a wall of said channel to locate and secure said spring support mounting relative to said channel, and a retracted position, and at least one spring in combination with the spring support.

2. A sash window counterbalance arrangement as claimed in claim 1 wherein said retractable mounting peg is resiliently biassed into said extended position.

3. A sash window counterbalance arrangement as claimed in claim 1 in which the support comprises a cantilevered portion from which the mounting peg extends; said cantilevered portion is cantilevered from the support and is arranged to resiliently deflect so as to retract said mounting peg.

4. A sash window counterbalance arrangement as claimed in claim 3 in which the cantilevered portion comprises:

a leg member which extends from and is connected at one end to the support;

a foot member which extends from the distal end of said leg member; and a flap portion which is supported from the distal end of the foot member with the mounting peg extending from said flap portion;

said flap portion disposed generally parallel to and spaced from said leg member by said foot member and with the flap portion arranged to be disposed in use generally parallel to the channel wall.

5. A sash window counterbalance arrangement as claimed in claim 1 wherein the spring support mounting comprises:

a main body, tang, a mounting peg projecting and extending from said tang; and the tang is connected at one end to the main body of the spring support mounting such that the tang can pivot about said end of the tang connected to the main body of the spring support mounting to retract said mounting peg and tang into said main body of the spring support mounting.

6. A sash window counterbalance arrangement as claimed in claim 5 in which a shoulder portion of said tang is defined at a distal end of said tang, said shoulder portion arranged to abut against said channel wall when said mounting peg is engaged in said mounting aperture.

7. A sash window counterbalance arrangement as claimed in claim 5 in which said tang is generally parallel to the said channel wall.

8. A sash window counterbalance arrangement as claimed in claim 5 in which said tang comprises a U shaped planar member.

9. A sash window counterbalance arrangement as claimed in claim 5 in which a distal end of said mounting peg has a sloped profile which is sloped in a direction towards said end of the tang connected to the main body of the spring support mounting.

10. A sash window counterbalance arrangement as claimed in claim 1 in which a distal end of said mounting peg has a sloped profile.

* * * * *